US010104974B1

(12) United States Patent
Baureis

(10) Patent No.: US 10,104,974 B1
(45) **Date of Patent: *Oct. 23, 2018**

(54) DEVICE AND METHOD FOR WARMING A SEAT

(71) Applicant: Steven Baureis, Verona, NJ (US)

(72) Inventor: Steven Baureis, Verona, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/468,690

(22) Filed: Mar. 24, 2017

Related U.S. Application Data

(62) Division of application No. 14/751,303, filed on Jun. 26, 2015, now Pat. No. 9,635,947, which is a division of application No. 13/227,607, filed on Sep. 8, 2011, now Pat. No. 9,074,793.

(51) Int. Cl.
*F25D 5/00* (2006.01)
*A47C 7/74* (2006.01)
*F24J 1/00* (2006.01)

(52) U.S. Cl.
CPC ..... *A47C 7/748* (2013.01); *F24J 1/00* (2013.01); *F25D 5/00* (2013.01)

(58) Field of Classification Search
CPC ..... F24C 7/748; F24J 3/00; F25D 5/00
USPC ..... 126/206, 263, 403; 62/4; 426/106, 123
See application file for complete search history.

(56) References Cited

U.S. PATENT DOCUMENTS 1,613,120 A 5/1925 O'Neal et al.
1,953,513 A 2/1931 Simmons
3,301,250 A 1/1967 Glasser
3,976,049 A 8/1976 Yamashita et al.
3,980,070 A 9/1976 Krupa
4,106,478 A 8/1978 Higashijima
4,604,987 A 8/1986 Keltner
D329,957 S 10/1992 Hartnett
5,398,667 A 3/1995 Witt
5,545,198 A 8/1996 Owens
5,833,309 A 11/1998 Schmitz
7,438,356 B2 10/2008 Howman et al.
2007/0006870 A1* 1/2007 Danforth ..... F24J 1/00 126/263.02
2008/0087271 A1* 4/2008 Ajiri ..... A61F 7/034 126/263.02
2012/0210996 A1* 8/2012 Pollock ..... A47J 36/28 126/263.05
2014/0109891 A1* 4/2014 Sonoda ..... A61F 7/034 126/263.02
2015/0157065 A1* 6/2015 Pierias ..... A41D 13/0051 126/204

* cited by examiner

*Primary Examiner* — Gregory Huson
*Assistant Examiner* — Nikhil Mashruwala
(74) *Attorney, Agent, or Firm* — Thomas L. Adams

(57) ABSTRACT

An air permeable envelope has a gripper for securing the envelope to a seat. A mixture contained in the air permeable envelope can react exothermically upon exposure to air. A sealed bag that is relatively air impermeable, initially holds the air permeable envelope and mixture together with the gripper. Upon opening and unsealing the bag, the mixture is exposed to air in order to start an exothermic reaction. The envelope and the gripper are removed from the bag and the gripper is used to attach the envelope upon the seat to warm it.

19 Claims, 4 Drawing Sheets

DEVICE AND METHOD FOR WARMING A SEAT

CROSS-REFERENCES TO RELATED APPLICATIONS

This is a divisional of U.S. patent application Ser. No. 13/227,607, filed 8 Sep. 2011.

BACKGROUND OF THE INVENTION

1. Field of the Invention

The present invention relates to warming devices and methods, and in particular, to warming a seat using an air-activated, exothermic reaction.

2. Description of Related Art

Many athletic events are performed at relatively cold temperatures, either outdoors or in an open-air stadium. The spectators will be relatively sedentary and can easily become chilled when sitting on stadium seats or simple bench-style bleachers. Often these seating arrangements will have a hard plastic or metal seat that tends to remain cold or even draw away body heat. To combat this problem, spectators will dress warmly and use blankets and the like, in order to try and retain their body heat.

Portable cushions have been placed on stadium seats for comfort and for insulation from the cold. However, cushions tend to be bulky, are easily misplaced or lost, and are inconvenient to carry back and forth. Also, vendors cannot easily travel through a stadium carrying stacks of cushions for immediate sale to spectators. Moreover, once purchased, portable cushions must be periodically cleaned and handled with care if one wishes to use the cushion repeatedly.

In addition, some stadium chairs have seats that swing up when the seated person rises. A cushion can prevent the seat from fully swinging and therefore impede movement in the vicinity of the chair. This problem can be exacerbated if the cushion is secured to the seat by straps or other mechanisms that interfere with the swinging motion of the seat. On the other hand, if unsecured, the cushion can slip and fall behind the chair, becoming difficult to retrieve.

A known heat pack uses a mixture of iron powder, water, activated charcoal, vermiculite, and salt. The iron powder is oxidized (rusts) in an exothermic reaction. Air and water are necessary for the reaction to proceed, but only the water is provided in the mixture. For this reason, the mixture is stored in an air permeable envelope that is then, in turn, sealed in a relatively air impermeable bag. When the envelope containing the mixture is removed from the bag, air can reach the mixture and start the exothermic reaction. The vermiculite and activated carbon are useful for storing and releasing water to accommodate the reaction. The activated carbon is also useful in storing and releasing the salt catalyst, as well as conducting and dispersing the heat generated by the exothermic reaction.

See also U.S. Pat. Nos. 1,613,120; 1,953,513; 3,301,250; 3,976,049; 3,980,070; 4,106,478; 4,604,987; 5,398,667; 5,545,198; 5,833,309; 7,438,356; and D329,957.

SUMMARY OF THE INVENTION

In accordance with the illustrative embodiments demonstrating features and advantages of the present invention, there is provided a device for warming a seat. The device includes an air permeable envelope having a gripper for securing the envelope to the seat. The device also includes a mixture contained in the air permeable envelope that exothermically reacts upon exposure to air. Also included is a sealed bag holding the air permeable envelope together with the gripper and the mixture. In comparison to the air permeable envelope, the bag is relatively air impermeable in order to restrict exothermic reaction with air of the mixture in the envelope.

In accordance with another aspect of the invention, there is provided a method for warming a seat by employing an exothermically reactive mixture inside an air permeable envelope that is initially sealed inside a relatively air impermeable bag together with a gripper. The method includes the step of opening and unsealing the bag to expose the mixture to air in order to start an exothermic reaction. The method also includes the step of removing the envelope and the gripper from the bag. Also included are the steps of using the gripper to attach the envelope upon the seat and sitting on the envelope.

By employing devices and methods of the foregoing type, one is able to provide warmth to a person using a seat. In a disclosed embodiment an air permeable envelope contains a mixture of iron, water and other useful ingredients such as activated carbon and salt. This envelope is stored in a sealed, relatively air impermeable bag. After removal from the bag, air can penetrate the air permeable envelope to begin an exothermic reaction.

The air permeable envelope containing this mixture will have a gripper adapted to secure the envelope to a seat. In one disclosed embodiment, the air permeable envelope will be encircled by an apron devoid of any mixture. The edge of the apron will be a hemmed to enclose an elastic member. This arrangement is relatively compact and therefore the air permeable envelope containing the exothermically reactive mixture can be easily stored in the air impermeable bag. Consequently, this envelope can be deployed with the elastic member stretched over a seat to hold the envelope in place.

In another embodiment, the gripper is an adhesive layer disposed on the air permeable envelope in two parallel strips. Release sheets placed over the adhesive layer can be removed just prior to installation of the envelope onto the seat. The adhesive layer is also relatively compact and therefore easily stored in the air impermeable bag as a part of the air permeable envelope containing the exothermically reactive mixture.

To make the device very compact, the envelope containing the mixture can be folded before being sealed into the air impermeable bag. In a disclosed embodiment the air permeable envelope can be made from two opposing sheets containing four discrete portions of the mixture. In this embodiment, the sheets are heat sealed together along the periphery and along two intersecting fold lines to form four discrete compartments containing four portions of the mixture. Accordingly, the envelope can be folded twice along the fold lines without disturbing the mixture contained in the four compartments. When folded in this manner, the device can be fairly compact and readily carried in a purse, pocket, or the like.

Once in place on the seat, the mixture will continue to exothermically react over, for example, several hours. Thus, a person seated on the seat will be warmed by the foregoing device and will be able to tolerate relatively cold temperatures for an extended period of time.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
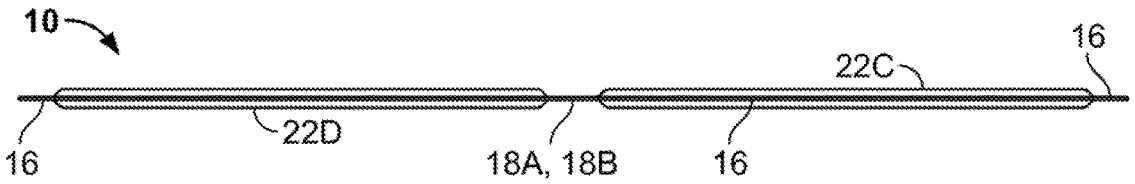
FIG. 1 is an edge view of an envelope containing an exothermically reactive mixture that is part of a device and method in accordance with principles of the present invention.
Figure 2:
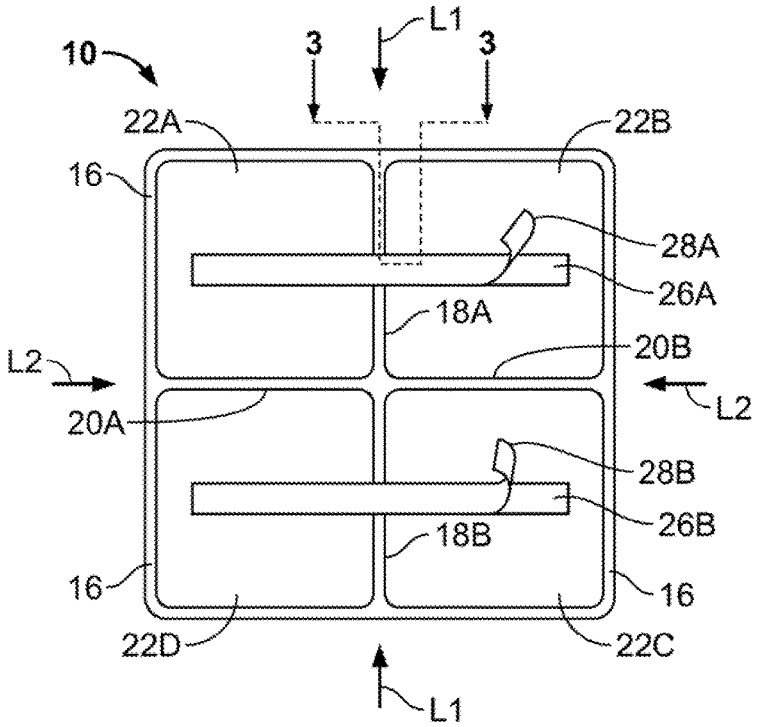
FIG. 2 is a plan view of the underside of the envelope of FIG. 1.
Figure 3:
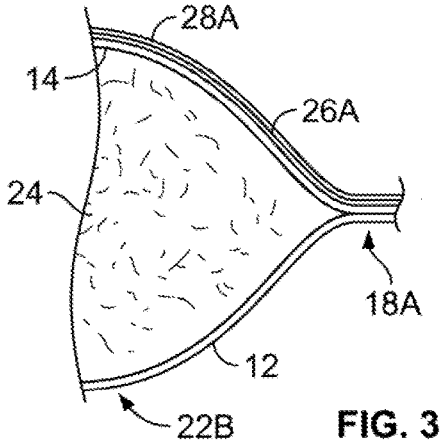
FIG. 3 is a cross-sectional view of a portion of the envelope of FIG. 1, taken along line 3-3 of FIG. 2.

Referring to FIGS. 1-3, an air permeable envelope 10 is shown as a pair of opposing sheets 12 and 14, which have a generally rectangular outline with rounded corners. The edges of this rectangular pair are heat sealed to form a closed peripheral boundary 16.

Envelope 10 is bisected twice by a transverse pair of fold lines L1 and L2, each reaching across to opposite edges of envelope 10. Sheets 12 and 14 are also heat sealed along fold line L1 in regions 18A and 18B. Similarly, sheets 12 and 14 are also heat sealed along fold line L2 in regions 20A and 20B. In some embodiments heat sealing may be eliminated in favor of other sealing techniques such as gluing.

The space between sheets 12 and 14 is thus divided into four discrete compartments 22A, 22B, 22C and 22D. Compartments 22A, 22B, 22C and 22D are each filled with a separate portion of mixture 24. While four compartments are illustrated, in other embodiments a different number of compartments may be provided (including the case where only one compartment is provided). One advantage of using separate compartments is that mixture 24 will be unable to shift across the full width of envelope 10 and will therefore tend to remain more evenly distributed. Since envelope 10 is segregated into compartments, the envelope may be considered a quilted envelope.

In this embodiment the ingredients of mixture 24 include powdered iron, water, salt (in this case, sodium chloride), and activated carbon. The water and salt may be deposited in the activated carbon as a salt solution. The activated carbon can then act as a supply source of water and salt as well as a medium for distributing heat generated by the mixture. In some embodiments the function of the activated carbon may be supplemented with vermiculite.

The iron in this mixture will readily oxidize when exposed to air to produce heat (exothermic reaction). Water supports the reaction and the salt acts as a catalyst. Exothermic chemical reactions of this type are disclosed in U.S. Pat. Nos. 3,301,250; 3,976,049; 3,980,070; and 4,106,478 While the foregoing mixture will operate satisfactorily, the present invention can be practiced using other mixtures, employing different constituents or different concentrations, in order to produce an exothermic reaction upon exposure to air.

The rate and duration of heat produced by mixture 24 can be adjusted by adjusting the constituents of the mixture and the permeability of sheets 12 and 14. The amount of iron in the mixture 24 will primarily determine the total number of calories that can be produced. The reaction rate of mixture 24 will determine the temperature and duration of the reaction. A higher reaction rate will produce a higher temperature of a shorter duration (a lower rate producing a lower temperature and longer duration). The concentration of water and salt in the activated carbon (and vermiculite if present) will affect the feed rate of water and salt and thus the reaction rate. The permeability of sheets 12 and 14 will also affect the reaction rate, with a higher (lower) permeability leading to a higher (lower) reaction rate.

The permeability of sheets 12 and 14 will be determined by the sheets' physical characteristics. Sheets 12 and 14 may be a fabric formed of natural or synthetic fibers. In other cases sheets 12 and 14 may be a plastic made with micropores. In some cases sheets 12 and 14 may be air permeable sheets of polyethylene, polypropylene, nylon, polyester, polyvinyl chloride, polyvinylidene chloride, polystyrene, natural rubber, synthetic rubbers, reclaimed rubbers, etc. In this embodiment, sheets 12 and 14 are essentially squares with sides that are 10 to 12 inches (25 cm to 30 cm) long, although other dimensions may be desired depending upon the intended use.

External adhesive layers 26A and 26B are laid down in two strips: one spanning compartments 22A and 22B, and the other spanning compartments 22C and 22D. While two disjoint segments are shown, other embodiments may employ a different number of segments (including a single segment) having different shapes. Release sheets 28A and 28B initially cover adhesive layers 26A and 26B, respectively, but will be removed when these layers are needed to act as grippers, in a manner to be described presently.

Figure 4:
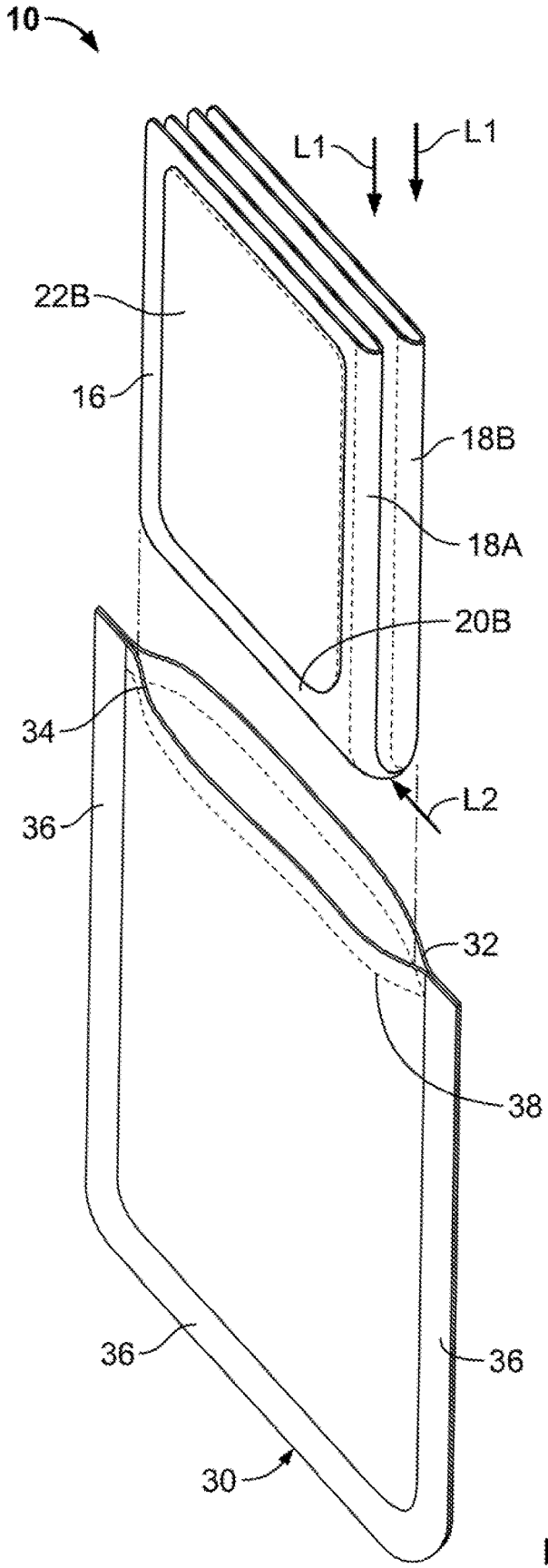
FIG. 4 is a perspective view of the envelope of FIG. 1 folded in order to fit inside the illustrated bag to form said device.

Referring to FIG. 4, previously mentioned envelope 10 is shown folded once along fold line L1 (regions 18A and 18B) and a second time along fold line L2 (regions 20A and 20B). Having been folded twice, envelope 10 can readily fit into bag 30. Bag 30 is formed from an opposing pair of sheets 32 and 34 that are shown heat sealed along border 36. Sheets 32 and 34 are essentially air impermeable so that when sealed, bag 30 will be air impermeable.

In FIG. 4 bag 30 is shown open on top so that folded envelope 10 can be inserted in (removed from) the opening. The opening can be heat sealed or glued along margin 38. In some embodiments, a side of the sealed bag 30 may be arranged to be torn open in order to access folded envelope 10. It will be understood that in some cases, folded envelope 10 will be placed between unattached sheets 32 and 34 before all edges of the bag are heat sealed or glued in a single pass. When envelope 10 is sealed in bag 30, the combination is herein referred to as device 10/30.

Because mixture 24 (FIG. 3) in envelope 10 will react to air, the mixture may be prepared in an inert atmosphere or vacuum. Likewise, the insertion of folded envelope 10 into bag 30 (FIG. 4) will be performed either in an inert atmosphere or vacuum. When finally sealed, bag 30 will be evacuated or will hold an inert gas so that mixture 24 in folded envelope 10 will not begin to exothermically react.

To facilitate an understanding of the principles associated with the foregoing device 10/30, its operation will be briefly described. With folded envelope 10 sealed in bag 30, mixture 24 will not react since the bag is substantially air impermeable and does not otherwise contain any appreciable amount of air. Being relatively compact, a person can readily carry bag 30 with envelope 10 in a pocket, purse, or other carrier.

In some cases, a person will carry device 10/30 to a sporting event; for example, an event in an open air stadium. The stadium will typically have many rows of chairs such as chair 32 of FIG. 5. Chair 32 has a back 34 mounted between a pair of side frames 36 (the upper portion of the right frame being broken away for illustrative purposes). Hinged on frames 36 are a pair of arms 38 (only one visible in this view) for supporting seat 40. In a well known manner, seat 40 and arms 38 can be swung up against back 34 to ease traveling past chair 32.

If the day is cold, a person may wish to use device 10/30. Therefore, bag 30 will be opened by tearing one of its edges, pulling apart one of its seams, or the like. Envelope 10 can then be removed in the folded condition shown in FIG. 4. Thereafter, envelope 10 will be unfolded as shown in FIG. 2. Specifically, envelope 10 will be unfolded twice, once along fold line L2 and then along fold line L1.

Figure 5:
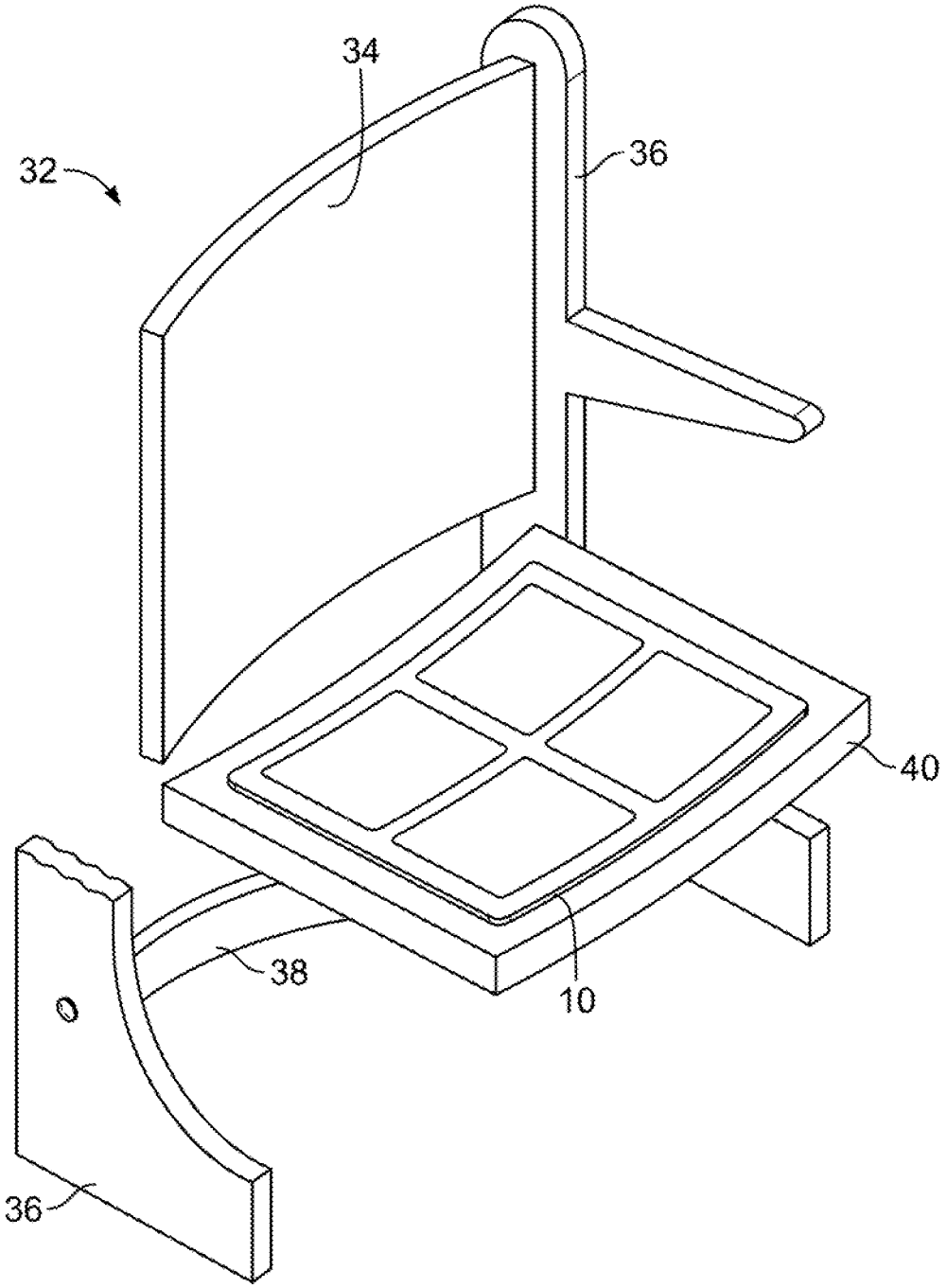
FIG. 5 is a perspective view of a seat fitted with the envelope of FIG. 1 in accordance with the method of the present invention.

Next, the user will remove release sheets 28A and 28B to expose adhesive layers 26A and 26B, respectively. Then, with the adhesive layers 26A and 26B facing down, envelope 10 will be placed atop seat 40 as shown in FIG. 5 so that the envelope will then adhere to seat 40. This adhesive feature will prevent dislodging of envelope 10 in the event of wind gusts or in the event that seat 40 should swing up against back 34. At this time a user will sit upon envelope 10.

Since sheets 12 and 14 are air permeable, air will reach mixture 24 to sustain an exothermic reaction that will generate heat. In this embodiment, with a given quantity of active ingredients in mixture 24, the reaction rate will be tailored to produce over a three to five hour time interval an average temperature of 100° F. (37.8° C.) with a maximum temperature of 107° F. (41.7° C.). It will be understood that depending upon the anticipated circumstances, device 10/30 can be designed to produce a different temperature over a different time interval. In some cases, the user may replace an expended envelope 10 with a fresh one.

When a user is ready to leave (or the exothermic reaction of mixture 24 has ended) envelope 10 with its mixture 24 will be lifted from seat 40 and discarded. Since the mixture 24 is environmentally safe, it can be discarded in any convenient refuse receptacle. Furthermore, the user need not worry about returning home with any heating equipment that needs to be cleaned or maintained.

Figure 6:
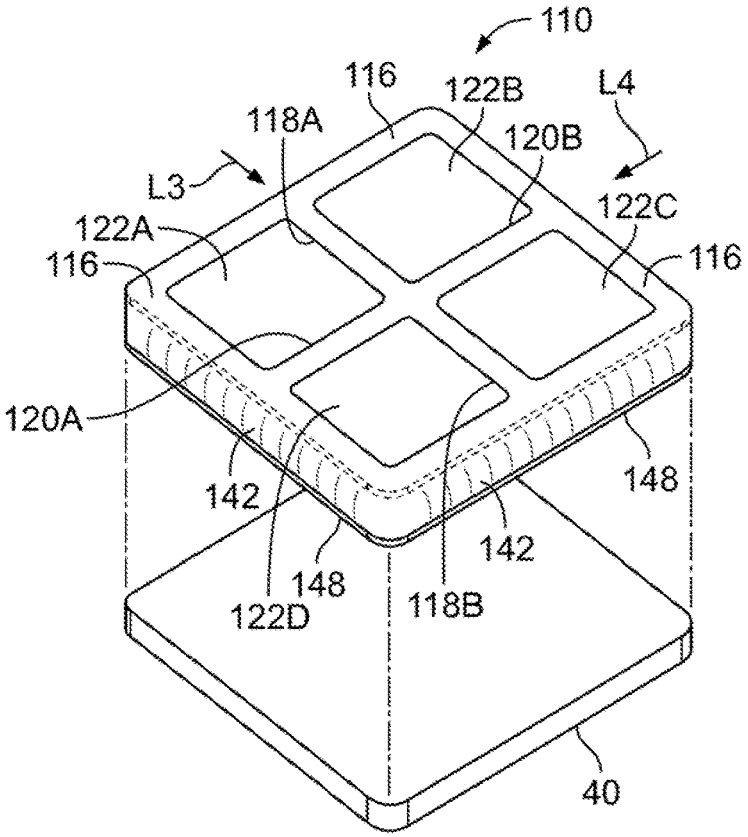
FIG. 6 is a perspective view of an envelope that is an alternate to that of FIG. 1.
Figure 7:
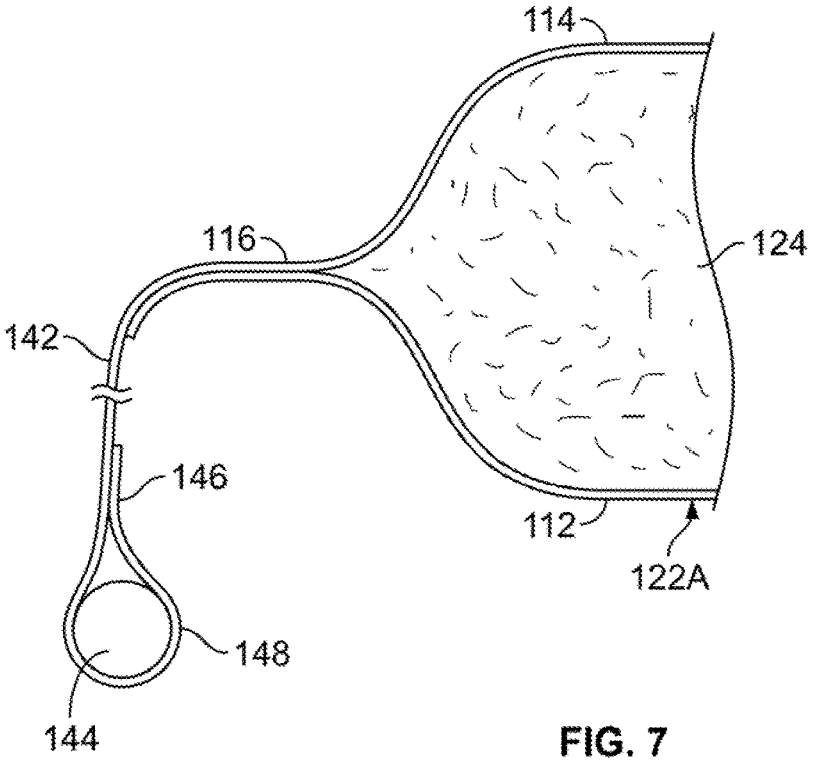
FIG. 7 is a cross-sectional view of a fragment of the envelope of FIG. 6, taken at the periphery of the envelope.

Referring to FIGS. 6 and 7, components corresponding to that previously illustrated in FIGS. 1-5 will bear the same reference numeral but increased by 100. As before, mixture 124 will be sealed between sheets 112 and 114 by heat sealing (or gluing) along border 116 as well as along regions 118A, 118B, 120A, and 120B to form four discrete compartments 122A, 122B, 122C and 122D. Fold line L3 runs along regions 118A and 118B, while fold line L4 runs along regions 120A and 120B.

Sheet 114 extends beyond sheet 112 to form an annular apron 142. Apron 142 is folded back around elastic member 144 and sealed at seam 144. Thus elastic member 144 is hemmed in place to form an elastic belt 148.

The foregoing envelope 110 can be folded twice in the manner previously described along fold lines L3 and L4 before being sealed inside an air impermeable bag similar to bag 30 of FIG. 4. Elastic belt 148 consumes little space and is therefore easily contained within a sealed bag.

When needed, envelope 110 will be removed from its sealed bag (e.g. bag 30 of FIG. 4) and will be unfolded in the manner previously described. A user may now stretch elastic belt 148 over the edges of previously mentioned seat 40 as illustrated in FIG. 6. Once under seat 40, elastic belt 148 can be released to contract so that apron 142 of envelope 110 will fit snugly over the edge of seat 40. Thus, belt 148 will act as a gripper to hold envelope 110 in place. As before, when expended or no longer needed, envelope 110 can be pulled off seat 40 and simply discarded.

It will be appreciated that various modifications may be implemented with respect to the above described embodiments. While the opposing sheets that form an envelope for holding the exothermically reactive mixture may be identical, in some embodiments the sheet intended to rest upon a seat may be thicker to provide insulation that prevents excessive heat loss to the environment. While the envelope is shown in FIG. 5 installed on a stadium seat, the envelope can also be installed on a bleacher bench, on a separate chair (e.g. a folding chair carried by a user), or any other seating surface that may be available. In some embodiments the elastic member at the edge of the apron will be eliminated in favor of an adhesive layer disposed on one side of the apron, in which case the apron may optionally be segmented into a number of discrete wings. In other embodiments the elastic member may be replaced with a drawstring. Some embodiments may have belts girdling the seat to act as grippers. While the foregoing envelope is shown with a generally rectangular outline, in some embodiments the envelope's outline may be circular, oval, polygonal, etc. Instead of a single envelope contained in a bag, some embodiments may have multiple envelopes in a single bag, and each envelope may have appropriate means for gripping a seat. For embodiments using multiple envelopes, the envelopes, after removal from a bag, may optionally be interconnected into a single structure by adhesives, snaps, zippers, etc. Instead of folding, some envelopes may be rolled into a cylindrical package before storage in an air impermeable bag.

Obviously, many modifications and variations of the present invention are possible in light of the above teachings. It is therefore to be understood that within the scope of the appended claims, the invention may be practiced otherwise than as specifically described.

The invention claimed is:

1. A device for warming a seat, comprising:

an air permeable envelope having a gripper for securing said envelope to said seat, said gripper having an external adhesive layer for holding said envelope to said seat;

a mixture contained in said air permeable envelope that exothermically reacts upon exposure to air;

a sealed bag holding said air permeable envelope together with said gripper and said mixture, in comparison to said air permeable envelope said bag being relatively air impermeable in order to restrict exothermic reaction with air of said mixture in said envelope.

2. A device according to claim 1 wherein said gripper comprises:

at least one release sheet for releasably covering said external adhesive layer.

3. A device according to claim 1 wherein said external adhesive layer is segregated into a plurality of disjoint segments.

4. A device according to claim 1 wherein said envelope is quilted to form a plurality of discrete compartments.

5. A device according to claim 1 wherein said envelope is partitioned along a plurality of fold lines into a plurality of non-communicating, discrete compartments, said envelope being folded along said fold lines and held in said sealed bag.

6. A device according to claim 5 wherein said plurality of fold lines include a transverse pair that makes the compartments four in number.

7. A device according to claim 5 wherein said envelope comprises an opposite pair of sheets that are sealed together along said plurality of fold lines and along a closed peripheral boundary encompassing said mixture.

8. A device according to claim 1 wherein said mixture is arranged to provide heat for at least 3 hours.

9. A method for warming a seat with an exothermically reactive mixture inside an air permeable envelope that is initially sealed inside a relatively air impermeable bag together with a gripper, the method comprising the steps of:

opening and unsealing said bag to expose the mixture to air in order to start an exothermic reaction;

removing said envelope and said gripper from said bag;

using said gripper to attach said envelope upon said seat; and sitting on said envelope.

10. A method according to claim 9 comprising the steps of:

rising from said envelope; and discarding said envelope and said gripper.

11. A method according to claim 9 comprising the steps of:

rising from said envelope at least 3 hours after first sitting on said envelope; and discarding said envelope and said gripper.

12. A method according to claim 9 wherein said gripper comprises an adhesive layer on said envelope, the step of using said gripper being performed by adhesively attaching said envelope to said seat using said adhesive layer.

13. A method according to claim 12 wherein said gripper comprises a release sheet initially covering said adhesive layer, the step of using said gripper being performed by removing said release sheet before adhesively attaching said envelope to said seat.

14. A method according to claim 13 comprising the step of:

discarding said envelope and said gripper.

15. A method according to claim 9 wherein said gripper comprises an elastic member peripherally attached to said envelope, the step of using said gripper being performed by fitting said elastic member over said seat in order to secure said envelope thereto.

16. A method according to claim 15 comprising the step of:

discarding said envelope and said gripper.

17. A method according to claim 9 wherein said envelope is partitioned along a plurality of fold lines into a plurality of non-communicating, discrete compartments holding said mixture in separate portions, the method comprising the step of unfolding said envelope along said fold lines after removal from said bag.

18. A method according to claim 17 wherein the step of unfolding said envelope is performed by unfolding twice along fold lines that include a transverse pair that makes the compartments four in number.

19. A method according to claim 17 comprising the step of:

discarding said envelope and said gripper.

* * * * *